US005511992A

United States Patent [19]

Thalhammer

[11] Patent Number: 5,511,992

[45] Date of Patent: Apr. 30, 1996

[54] DEVICE FOR MOLDING A SHIELDED CABLE PLUG

[75] Inventor: Erich Thalhammer, München, Germany

[73] Assignee: Siemens Aktiengesellschaft, Munich, Germany

[21] Appl. No.: 428,156

[22] PCT Filed: Oct. 8, 1993

[86] PCT No.: PCT/EP93/02759

§ 371 Date: Apr. 27, 1995

§ 102(e) Date: Apr. 27, 1995

[87] PCT Pub. No.: WO94/10724

PCT Pub. Date: May 11, 1994

[30] Foreign Application Priority Data

Oct. 29, 1992 [DE] Germany ..... 92 11 853.3

[51] Int. Cl.[6] ..... H01R 13/648

[52] U.S. Cl. ..... 439/609; 439/108

[58] Field of Search ..... 439/92, 95, 108, 439/607, 609

[56] References Cited

U.S. PATENT DOCUMENTS 4,370,515 1/1983 Donaldson .

5,307,242 4/1994 Seibold et al. .

FOREIGN PATENT DOCUMENTS 0412331 2/1991 European Pat. Off. .

3515772 11/1986 Germany .

920578 U 8/1990 Germany .

9207674 U 12/1990 Germany .

*Primary Examiner*—Khiem Nguyen

*Attorney, Agent, or Firm*—Hill, Steadman & Simpson

[57] ABSTRACT

A cable plug enclosed by a shielding housing can be plugged onto a plug connector of a backplane printed circuit board. The shielding housing can make contact with shielding metal sheets arranged along the long sides of the plug connector. The shielding metal sheets are extended beyond the contact-making region and form guiding sections into which are cut, starting from the top edge, guiding slots for hook-like guiding lugs of the shielding housing (11). The shielding metal sheets, the guiding slots and the guiding lugs engage around one another alternately in such a way that the cable plug is held on the backplane printed circuit board in an approximately rigid manner.

9 Claims, 1 Drawing Sheet

DEVICE FOR MOLDING A SHIELDED CABLE PLUG

BACKGROUND OF THE INVENTION

The invention relates to a device for holding a shielded cable plug on a plug connector of backplane wiring of a mounting rack, which device is provided with shielding metal sheets.

A device of this type has been disclosed, for example, by the documents of German Utility Model 92 05 780. According to this document, the shielding metal sheets are arranged along the side walls of a plug housing and are provided with spring tongues which make contact with a shielding housing enclosing the cable plug. The spring metal sheets are extended beyond the contact-making region in the insertion direction and form guiding sections on which the cable plug is precentered during insertion onto a plug connector. The guiding sections are connected to the contact-making region via displaceable connecting webs.

Furthermore, the documents of German Utility Model 92 07 674 disclose protruding latching lugs being bent out on the shielding housing, said lugs projecting into corresponding perforations in the connecting webs, with the result that the cable plug is secured against being pulled out unintentionally. Since the relatively long cable plug is held in a manner such that it can tilt to the side within certain limits, the perforations are considerably wider than the latching lugs, in order that a secure latching is obtained.

In the case of cable plugs of this type, lateral forces can act on the plug during work on neighboring connecting cables, which forcus are able to change the angular position of the plug and hence to impair both the contact security at the plug contacts and the shield security.

SUMMARY OF THE INVENTION

The invention is based on the object of fixing the plug on the shielded plug connector in such a way that its angular position can be changed only minimally.

This object is achieved by virtue of an improvement in a device for holding a shield cable plug on a plug connector of backplane wiring of a mounting rack, which device includes shielding metal sheets which, along side walls of a plug housing of the plug connector, have spring tongues which can make contact with a shielding housing enclosing the cable plug, and the spring metal sheets extend beyond the contract-making region to form a guiding section which bears against the shielding housing of the cable plug. The improvement comprises guiding slots, which are open toward the outside and extend in the insertion direction and are cut into the guiding sections, the shielding housing of the cable plug has protruding guiding webs which engage with little play into the guiding slots, and the shielding housing is provided with the hook-like projections which engage around the shielding walls. In this case, the guiding webs engage in the corresponding slots without any play, whereby the plug can no longer be moved in the direction parallel to the side walls. The hook-like projections which engage behind the shielding metal sheets prevent the possibility of the shielding housing being moved away from the shielding walls in the event of a force which acts transversely with respect to the shielding walls. In this case, the guiding forces of the two shielding metal sheets on both sides of the plug connector are added. These measures mean that the latched-on cable plug is held on the shielded plug connector in a virtually rigid manner, with the result that the contact security is not impaired, even in the case of unintentional pulling on the plug cable. The robust retention additionally prevents the shielding housing from being lifted off the shielding metal sheet to such an extent that the latching lugs come out of the perforations.

The preferred embodiment has the hook-like projections formed or fitted directly on the guiding web to form hook-like guiding lugs with the distance or spacing between the hook-like projection and the shielding housing being approximately equal to the thickness of the shielding metal sheets. This structure means that only a single compact structural element is needed for both-coordinate directions and results in a reduction in the production expenditure. A particular advantage is that the guiding web and the hook-like projection guide each other and secure each other's position, as a result of which a particularly robust plug connection with the shielding metal sheet is achieved.

The hook-like guiding lug has the guiding web and hook-like projection lying in one plane, and the hook-like projection projects beyond the guiding web in the insertion direction and beyond the end of the guiding slot. This structure for the guiding lug can be implemented using a simple cut profile, with the result that additional bending for the hook-like projection is eliminated.

In the preferred embodiment, the hook-like guiding lug is bent out from a metal lamina which is fixed to the inner wall of the shielding housing which has slot-like apertures for the guiding lugs to extend through and the width of each of the slot-like apertures is approximately equal to the thickness of the metal lamina, this structure means that the openings in the shielding housing are considerably smaller than when the projections are directly cut free from the shielding housing and bent out. The metal lamina can be fitted in a plug section between the plug housing and the cable entry, so that the corresponding wall thickening still has no disturbing influence.

In the preferred embodiment, not only the guiding lugs but also latching lugs are bent from the metal lamina. These latching lugs project through additional slot-like apertures, which are formed in the shielding housing, and into perforations in the guiding sections of the shielding metal sheets. This structure also means that the latching lugs can also be bent out from the lamina in a simple manner and passed through closely matched perforations in the shielding housing. Thus, the shielding housing has no damaging openings, even in the region of the latching lugs.

It is also desirable that open longitudinal slots, which extend in the insertion direction, are formed in the shielding metal sheets between the guiding slots for the guiding lugs and the perforations for the latching lugs. This structure means that sprung tabs which are decoupled from one another are formed on the shielding metal sheets for each latching lug and each guiding lug, with the result that, when the cable plug is inserted, the tabs assigned to the latching lugs can be displaced without the remaining tabs, which are assigned to the guiding lugs, also being moved. The latter tabs can consequently bear closely against the shielding housing during the entire insertion operation, with the result that they can be reliably engaged with the guiding lugs.

Other objects, advantages and features of the invention will be apparent from the following description of the preferred embodiment, the drawings and claims.

DESCRIPTION OF THE PREFERRED EMBODIMENTS

Figure 1:
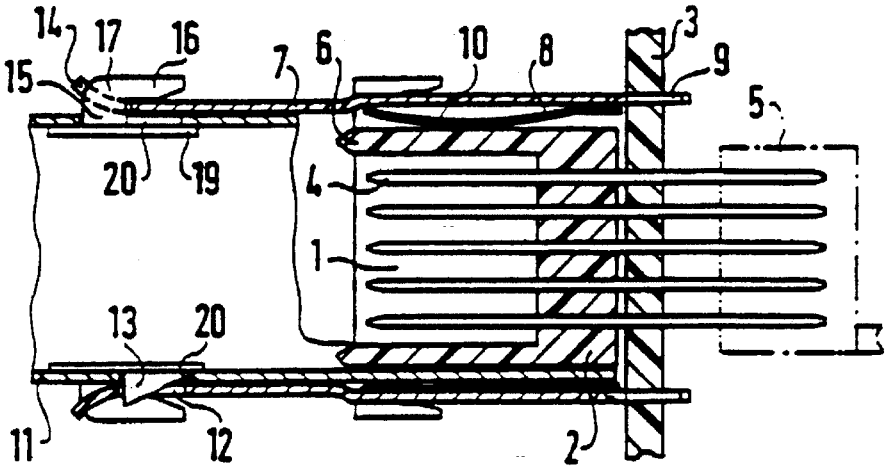
FIG. 1 is a cross sectional view with portions broken away for purposes of illustration through a plug connector on a wiring backplane having a shielding housing of a cable plug.
Figure 2:
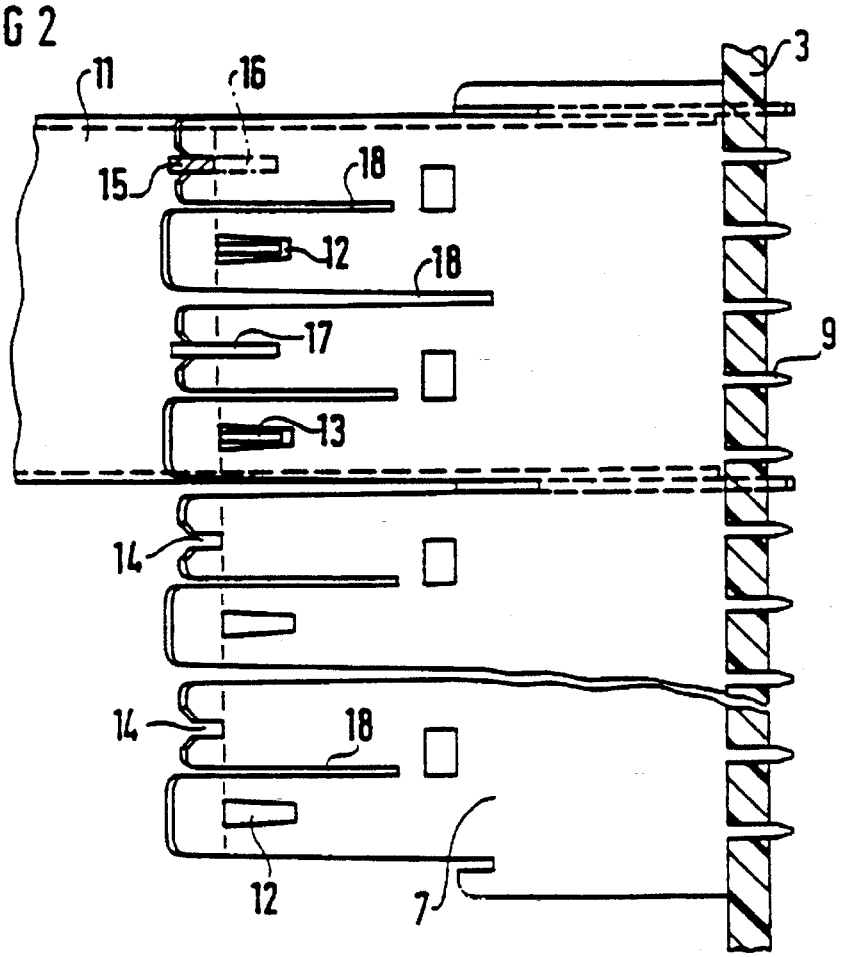
FIG. 2 is a side view of the arrangement according to FIG. 1.

According to FIGS. 1 and 2, a plug connector 1 having a plug housing 2 is placed onto a backplane printed circuit board 3. Plug pins 4 project through said printed circuit board and the plug housing 2, and the pins 4 form on that side of the backplane printed circuit board 3; which faces away from the plug connector 1 plug contact points for plug-in assemblies 5 which can be pushed into a mounting rack, on the rearside of which the backplane printed circuit board 3 is fixed.

The plug housing 2 has side walls 6 on its long sides, along which walls extend shielding metal sheets 7 which are provided on their inner surface or side with contact spring strips 8. The shielding metal sheets 7 are fixed or mounted in holes in the backplane printed circuit board 3 by means of pins 9, which Jut out like a comb, and are connected to ground. The contact spring strips 8 bear against the shielding metal sheets 7, bulge out in their central region towards the side walls 6 And are provided with transverse slots, between which spring tongues 10 are formed. A shielding housing 11 of a cable plug is pushed in by its shielding walls between the spring tongues 10 and the side walls 6 and makes contact with the spring tongues 10.

The shielding metal sheets 7 are extended beyond the contact spring strips 8 in the insertion direction and form on their upper side guiding sections provided with slot-like perforations 12 into which latching lugs 13, which jut out from the shielding housing 11, project and thus secure the cable plug against being pulled out unintentionally.

Guiding slots 14, which extend in the insertion direction and into which are pushed guiding webs 15 which jut out perpendicularly from the shielding housing 11 are cut out on the side walls 7, in addition to the perforations 12, starting from the insertion side. Hook-like projections 16, which lie in the material plane of the guiding webs 15, extend beyond the base of the guiding slots 15 and engage behind the shielding metal sheet 7 with little play. The hook-like projection 16 are attached to the guiding webs 15. The projection 16 together with the guiding webs, hook- like guiding lugs 17, which hold the shielding housing 11, together with the latching lugs 13, in a positively locking manner on the shielding metal sheets 7 in all coordinate directions. Lateral forces acting on the cable plug are thereby transferred to the shielding metal sheets 7 at a distance from the plug pins 4 and with favorable leverage, with the result that the cable plug assumes a virtually rigid position with respect to the plug connector 1. In this arrangement, entry chamfers on the guiding slots 14 and the hook-like projections 16 facilitate the mating of the parts.

Starting from the upper edges, longitudinal slots 18, which extend in the insertion direction are cut into the shielding metal sheets 7 between the perforations 12 and the guiding slots 14 to produce displaceable tabs which are decoupled from one another. It is thereby possible, when the cable plug is inserted, to spread out the tabs having perforations 12 when the latching lugs 13 impinge, without in the process changing the position of the tabs having the guiding slots 14. Due to the spring properties of the tabs, the shielding housing 11 makes contact with the side walls 7 in addition to the spring tongues 10, which further improves the shielding effect of the device.

The latching lugs 13 and the guiding lugs 17 are cut and bent out of a separate metal lamina 19 which is fixed on the inner side of the shielding housing 11. Slot-like apertures 20, 20, are formed in the shielding housing for the guiding lugs 17 and the latching lugs 13, respectively, the width of said apertures being approximately equal to the thickness of the metal laminae 19. In this way, the shielding housing 11 remains largely closed in respect of its shielding effect.

I claim:

1. In a device for holding a shielded cable plug on a plug connector on a backplane wiring of a mounting rack, the device having shielding metal sheets along side walls of a plug housing of the plug connector with spring tongues, which can make contact with a shielding housing enclosing the cable plug, and the shielding metal sheets being extended beyond the contact-making region to form guiding sections which bear against the shielding housing of the cable plug, the improvement comprising guiding slots, which are open toward the outside and extend in the insertion direction, being cut into the guiding sections, the shielding housing of the cable plug having protruding guiding webs which engage with little play into the guiding slots, and the shielding housing being provided with hook-like projections which engage around the shielding metal sheets.

2. In a device according to claim 1, wherein the hook-like projections are fitted directly on the guiding webs to form hook-like guiding lugs, and wherein the distance between the hook-like projections and the shielding housing is approximately equal to the thickness of the shielding metal sheet.

3. In a device according to claim 2, wherein the hook-like guiding lugs are bent out from a metal lamina fixed to the inner wall of the shielding housing which has slot-like apertures for the guiding lugs, and in that the width of each of the slot-like apertures is approximately equal to the thickness of the metal lamina.

4. In a device according to claim 3, which includes latching lugs being bent from the metal lamina, said latching lugs projecting through additional slot-like apertures in the shielding housing and into perforations in the guiding sections of the shielding metal sheets.

5. In a device according to claim 4, wherein open longitudinal slots, which extend in the insertion direction, are formed in the shielding metal sheets between the guiding slots for the guiding lugs and the perforations for the latching lugs.

6. In a device according to claim 2, wherein the guiding web and the hook-like projection lie in one plane, and the hook-like projection projects over the guiding web in the insertion direction beyond the end of the guiding slot.

7. In a device according to claim 6, wherein the hook-like guiding lugs are bent out from a metal lamina fixed to the inner wall of the shielding housing, which has slot-like apertures for the guiding lugs, and in that the width of each of the slot-like apertures is approximately equal to the thickness of the metal lamina.

8. In a device according to claim 7, which includes latching lugs being bent from the metal lamina, said latching lugs projecting through additional slot-like apertures in the shielding housing and into perforations in the guiding sections of the shielding metal sheets.

9. In a device according to claim 8, wherein the shielding metal sheets have open longitudinal slots extending in the insertion direction between the guiding slots for the guiding lugs and the perforations for the latching lugs.

* * * * *